United States Patent [19]

Campbell et al.

[11] 4,366,962

[45] Jan. 4, 1983

[54] LOW DRAG, LIGHT WEIGHT TOWED TARGET

[75] Inventors: Richard L. Campbell; Clayton G. Coffey, both of Medicine Hat, Canada

[73] Assignee: Her Majesty the Queen in right of Canada, as represented by the Minister of National Defence, Ottawa, Canada

[21] Appl. No.: 178,185

[22] Filed: Aug. 14, 1980

[30] Foreign Application Priority Data

Mar. 5, 1980 [CA] Canada ..... 347192

[51] Int. Cl.[3] ..... F41J 9/08; F41J 9/12

[52] U.S. Cl. ..... 273/360; 343/18 R; 343/18 C

[58] Field of Search ..... 273/360, 361; 343/18

[56] References Cited

U.S. PATENT DOCUMENTS

| | | | |
|---|---|---|---|
| 2,809,606 | 10/1957 | Bates | 273/360 X |
| 2,821,396 | 1/1958 | Seeley | 273/360 |
| 3,010,103 | 11/1961 | Hopper et al. | 273/360 X |
| 3,065,967 | 11/1962 | Homphrey et al. | 273/360 |
| 3,086,202 | 4/1963 | Hopper et al. | 273/360 X |
| 3,283,324 | 11/1966 | Norman, Jr. | 343/18 R |
| 3,311,376 | 3/1967 | Woodward et al. | 273/360 |
| 3,735,985 | 5/1973 | Layer et al. | 273/360 X |
| 4,037,228 | 7/1977 | Pearson | 273/360 X |

*Primary Examiner*—Paul E. Shapiro

*Attorney, Agent, or Firm*—Stevens, Davis, Miller & Mosher

[57] ABSTRACT

A modular target apparatus is described, which is adapted to be towed behind a towing vehicle, typically an aircraft. The modular apparatus includes a fore body, an aft body, and a thrust bearing interconnecting said bodies. The thrust bearing allows predetermined amounts of relative movement between the two bodies. The fore body is tubular and normally houses a miss distance indicator (MDI) device. The aft body has an aerodynamically shaped front end, and includes a trailing skirt. These coact to provide dynamic stability when the target apparatus is being towed. The front end of the aft body is preferably configured to house augmentation means which provides enhancement of a predetermined signal. This is most preferably in the form of a Luneberg lens. At least one of the fore and aft bodies is sometimes a substantially empty tube-like element. The trailing skirt has guides thereon which cause the aft body to follow a predetermined path of motion. The guides are most preferably remotely actuatable guide vanes moveable to selected positions which will determine the path of motion followed.

13 Claims, 2 Drawing Figures

LOW DRAG, LIGHT WEIGHT TOWED TARGET

This invention relates to a target apparatus adapted to be towed by a towing vehicle such as an aircraft, ship or the like. More particularly, the invention relates to a target apparatus that includes modular component parts so as to be adaptable for use in a number of different configurations/modes.

BACKGROUND OF THE INVENTION

There are times when it is necessary to exercise military personnel such as fighter pilots, radar officers, gunners and the like, using moving targets. A variety of problems arise, however, such as a lack of compatibility of operations in one mode of exercise with that of some other mode. Also a target that is highly "visible" to radar may be visually almost invisible, or vice versa. Further yet, it may be highly desirable to track or follow a gunner's firing in order to evaluate his progress. Similarly, problems of visibility also arise in having fighter aircraft pilots "hit" or come within a predetermined distance of a target towed behind another aircraft. In most instances where an airborne target is used, launching and recovery of the target presents additonal areas of difficulty. Some of these areas of concern have been overcome individually, however, problems in flexibility of operations have continued to the present day.

SUMMARY OF THE INVENTION

The apparatus of this invention has been highly successful in experimental trials at providing improved flexibility of operations. In an airborne mode, the apparatus embodied by this invention is easily launched and recovered. Further it is stable in flight, yet can be adapted to follow a preselected path of motion.

Accordingly, one form of this invention envisages a modular target apparatus adapted to be towed behind a towing vehicle comprising a tubular fore body selectively adaptable to house a miss distance indicator device (MDI), said fore body having a trailing end and a forward end, and being releasably connectible to a tow cable carried by the towing vehicle, thrust bearing means attachable to the trailing end of the fore body, and, an aft body of larger cross-sectional area than the fore body, the two bodies being attachable together by the thrust bearing means in a manner enabling selected amounts of relative movement therebetween, the aft body having an aerodynamically shaped front end and a trailing skirt, the front end of the aft body being configured to house augmentation means for selected signal enhancement and the trailing skirt including means thereon to cause the aft body to follow a predetermined path of motion.

In another and more preferred embodiment of the invention, there is provided modular target apparatus adapted to be towed behind a towing vehicle, comprising, a tubular fore body module adaptable to house a miss distance indicator device (MDI), the module having a forward end and a trailing end, and being releasably connectible to a tow cable carried by the towing vehicle, thrust bearing means attachable to the trailing end of the module, the thrust bearing means being configured to enable selectively relative motion, and an aft body of a larger cross-sectional area than the fore body module and releasably connectible to the latter by the thrust bearing means, the aft body having a front end shaped aerodynamically to promote dynamic stability thereof when being towed, the aft body also having a trailing skirt which coacts with the front end to assist in to the dynamic stability, the aft body being configured to house selected augmentation means for predetermined signal enhancement, and the trailing skirt being provided with guide means thereon which cause the aft body to follow a predetermined path of motion.

In yet another preferred arrangement, the guide means on the aft body are adjustably moveable vanes, operable to cause the target apparatus to follow a predetermined path of motion. The vanes can be adjustably moveable directly, or remotely in response, say, to a radio signal.

These and other features and advantages of this invention will become more apparent from the detailed description below. That description should be read in conjunction with the accompanying drawings which illustrate a preferred embodiment of apparatus encompassed by this invention.

FIG. 1 is a perspective view of the modular target apparatus of this invention; and FIG. 2 is a sectional view along line 2—2 of FIG. 1 showing the tubular body.

DESCRIPTION OF THE PREFERRED EMBODIMENT

Figure 1:
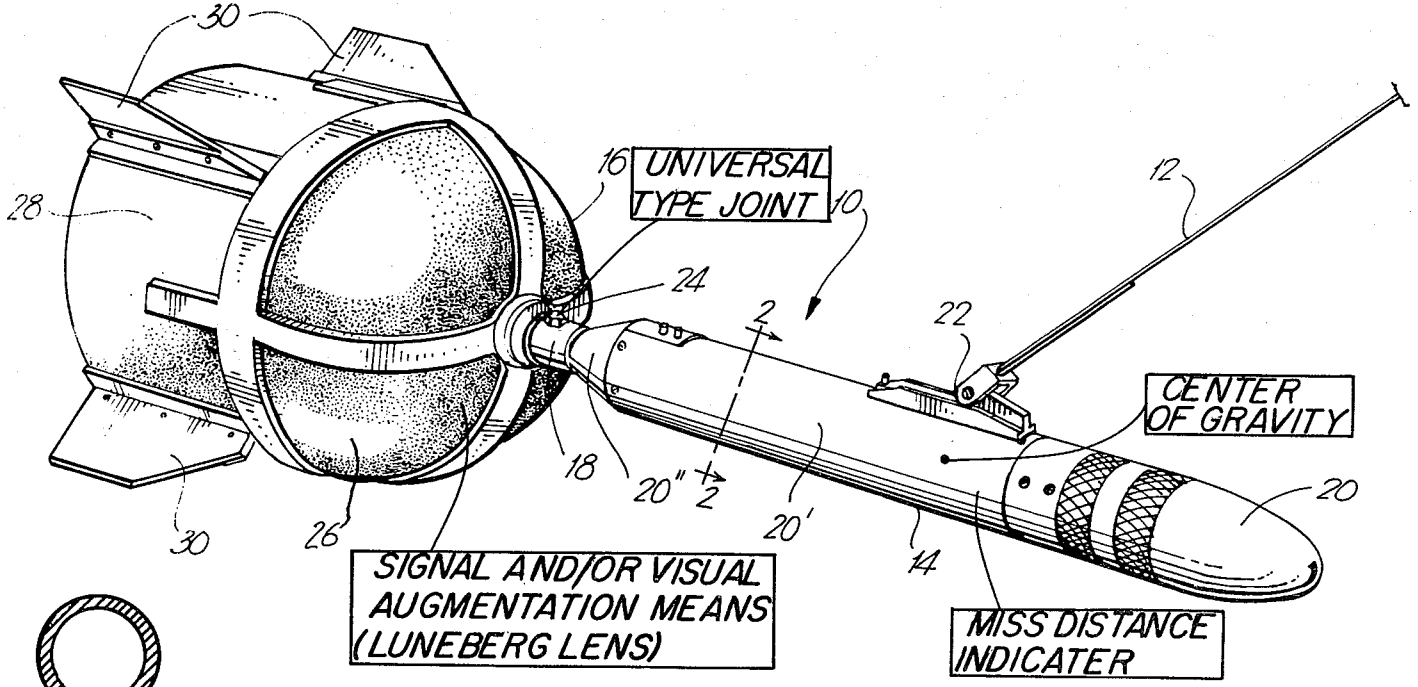
Figure 2:
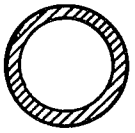

There is shown in FIG. 1 a target apparatus 10, adapted to be towed by a tow line 12 carried aboard a towing vehicle, not shown. The towing vehicle will usually be an aircraft or ship depending upon whether the target 10 is airborne or submerged. The description which follows will be directed primarily towards an airborn target apparatus.

As seen in the drawing, the target apparatus 10 comprises a fore body 14, an aft body 16 and a thrust bearing 18 serving to releasably interconnect said fore and aft bodies. Fore body 14 is an elongated tube, typically circular in cross-section and having a diameter in the range of, for example, 50 to 22 mm. The fore body 14 is normally made of metal, and in two or more sections shown at 20, 20' and 20''. These sections 20, 20' and 20'' are releasably coupled together, as by threaded couplings, set screws or the like. As noted, the fore body 14 is tubular, and normally houses an electronic package, such as an acoustic miss distance indicator (MDI) Model AS-131SC of Aeronic A.B. or radar-type MDI, such as Model 91991 of Resdel Engineering, U.S.A.; or radar-type MDI Model CADSS-1A of Cartwright Engineering, U.S.A. These devices depend on either acoustical or Doppler radar sensors. For the former, sensing depends on the projectile (rocket, bullet, etc.) travelling at a supersonic velocity and creating a shock wave which is then detected.

Radar indicators depend on a Doppler shift of the signal reflected back from the moving projectile. In both instances the information sensed is recorded and telemetered to a ground based station. The required transmitters are housed in the fore body 14. Details of the conventional MDI or BHI are not required for an understanding of the present invention.

Returning to the drawing, a coupling 22 is secured to the exterior of the fore body 14. This coupling 22 normally provides for pivotal relative movement between the tow cable 12 and fore body 14. Further, the line of force of the load carried by cable 12 is, by appropriately positioning the coupling 22, caused to pass through the centre of gravity of the target apparatus 10.

The thrust bearing 18 is somewhat analagous in construction to a "universal joint". As such, thrust bearing 18 contains at least one pivot pin shown at 24, and enables relative motion between the fore and aft bodies 14 and 16. Such motion may be about the axis of pin 24, about a longitudinal axis coaxial with fore body 14 or a combination of these. Locking means are usually provided as part of the thrust bearing 18 to enable it to be fixed selectively, if desired. In this way the fore and aft bodies 14 and 16 could be left freely moveable relative to one another, or fixed at a predetermined orientation.

The aft body 16 is typically a one piece unit, moulded of a polymeric material such as polyethylene, polyvinylchloride, or the like. The body 16 is normally transparent to a radar signal. Aft body 16 includes an aerodynamically shaped hemi-spherical front end 26 and a trailing skirt 28 generally connected integrally to the front end 26. Although skirt 28 does slightly increase drag forces, it primarily coacts with front end 26 to stabilize the target apparatus 10 in flight. This is somewhat surprising since flow around a sphere is usually balanced and uniform. It was found, however, that skirt 28 actually avoids the unstabilizing effect of trailing vortices formed alternately on opposite sides of the flow downstream of the sphere, i.e., spherical front end 26.

The trailing skirt 28 has guide means thereon, generally in the form of symmetrically positioned guide vanes or rudders shown at 30. Although not shown in the drawing, guide vanes 30 could be adjustable. The vanes 30 are disposed in planes extending radially outwardly from the central longitudinal axis of the target apparatus. Thus, adjustability of the vanes 30 would usually be derived from pivotal movement of one or more vanes 30 transversely of those radial planes. Preferably, this adjustability is derived from an electronic control circuit and a small electric motor within the aft body 16, actuated in response to radio signals supplied, for example, from the towing vessel or a control station located remote from the target apparatus 10.

As yet another alternative, preprogrammed avionics or signals can be used to actuate the guide vanes 30 in a predetermined manner. Adjustment of the vanes 30 will cause the target apparatus to follow a desired path of motion.

It is evident from the drawing that the aft body 16 is of a larger cross-sectional area than fore body 14, say, 150 mm to about 400 mm in diameter. In this way the front end 26 and trailing skirt 28 form a housing or enclosure that is open in the downstream direction. That opening allows a "Luneberg" lens, a "corner reflector" or a cluster thereof to be inserted within the aft body 16 to make the same more visible to radar signals. Such devices are secured to the interior surface of the front end 26, and their construction and operation are well known in this art.

To provide visual augmentation, a high intensity light is mounted in a transparent front end 26, and a second light in the trailing skirt 28. These lights are powered by a battery carried in the fore body 14, or by a small generator driven by rotation of the aft body 16. It is noted here that in airborne operations, the aft body 16 will normally be rotatable, unless the thrust bearing 18 has been locked against rotation.

Visual augmentation can also be provided by "smoke", such as that forming as a result of the reaction, for example, of chlorosulphonic acid with air. Cannisters containing such acid are mounted in the trailing skirt 28. Valve means on that cannister are actived by remote control or radio link from the towing vessel (aircraft) or from a ground based control station, to release predetermined quantities of the chemical.

A further mode of visual augmentation is derived by using ribbons, ropes, or streamers, connected at one end to a shroud encompassing the guide vanes 30 and forming a sleeve (not shown). A tubular shape is retained in flight by tying the other ends of such ribbons or ropes to a ring of similar diameter to the shroud.

The use of an aerodynamically shaped front end 26 with a trailing skirt 28 affords great in-flight stability to the target apparatus 10. Moreover, the fore body 14 and aft body 16 being tubular in form enables the same to be kept light in weight, for example less than about 10 kg. This has the double advantage that a lighter tow cable 12 can be used, and that for the same weight a longer cable in the range of up to about 3000 meters will position the target apparatus 10 a safer distance from the towing vessel. Perhaps of even greater importance is the fact that lighter weight and improved aerodynamic stability result in smaller vertical separations between the towing vessel and target apparatus 10. This in turn greatly reduces drag forces on the tow cable 12. These latter forces can exceed drag on the towed apparatus by up to a factor of 4. With those drag forces reduced to a fraction of what they had been, a lighter aircraft, winch mechanism and cable are used, accompanied by reduced operating costs and greater reliability in recovery of the target apparatus. It will be recognized that such target apparatus are usually carried from winch apparatus that is wing mounted in an aircraft. Air flow close to that winch is very unstable, and thus flight stability of the target increases the ease and reliability of docking operations. Naturally, if the target apparatus 10 contains costly electronic packages, the feature of reliable recovery gains in importance.

The following table gives an example of the measured total drag of the target and tow line as seen by the aircraft, at different velocities of flight. The drag forces on the target were calculated knowing the physical characteristics of the latter, and the drag on the tow line is the difference between the measured total drag minus the calculated drag of the target itself. A tow line of 10,000 feet (3048 meters) in length, and 0.041 inches is diameter was used.

| SPEED | DRAG | | |
|---|---|---|---|
| (knots) | Total | Target | Tow Line |
| 200 | 100 lbs | 20 lbs | 80 lbs |
| 250 | 133 lbs | 31 lbs | 117 lbs |
| 300 | 180 lbs | 44 lbs | 136 lbs |
| 350 | 257 lbs | 60 lbs | 197 lbs |

Thus, the drag to weight ratio of target apparatus embodying this invention is designed to minimize drag on a tow cable. Aircraft performance, as well as that of the winching mechanism are improved. Further, the decoupling capability with respect to the two portions of the target apparatus, i.e., fore and aft bodies, provides versatility. The rotational rate of the aft body, for example, can smooth a non-smooth radar reflectance with "corner reflectors" to one approaching that of an omnidirectional "Luneberg" lens, but at a fraction of the costs. The decoupling capability also provides flexibility in relation to configurations for radar, visual or acoustic augmentation.

The foregoing apparatus and variations thereto which are apparent to those skilled in this art are intended to be encompassed by the claims below.

The embodiments of the invention in which an exclusive property or privilege is claimed are defined as follows:

1. A modular target apparatus adapted to be towed behind a towing vehicle, comprising:

a tubular fore body housing a miss distance indicator device, said fore body having a trailing end and a forward end, and having means for releasably connecting to a tow cable carried by said towing vehicle;

thrust bearing means at the trailing end of said fore body; and an aft body of larger cross-sectional area than said fore body, the two bodies being attachable together by said thrust bearing means in a manner enabling relative movement therebetween, said aft body having a hemi-spherical aerodynamically shaped front end and a trailing circular skirt, which coacts to provide dynamic stability while being towed, the front end of said aft body housing augmentation means for selected signal enhancement and the trailing circular skirt including means thereon to cause said aft body to follow a predetermined path of motion.

2. The modular target apparatus defined in claim 1 wherein said augmentation means is a Luneberg lens integral with said front end of the aft body.

3. The modular target apparatus defined in claim 1, wherein said trailing skirt has rudders to control said target apparatus to move along a predetermined path.

4. The apparatus defined in claim 3 wherein said rudders are remotely operable to render said target apparatus remotely maneuverable.

5. The apparatus defined in claim 1, 2 or 3, wherein said thrust bearing means permits selected amounts of rotation about a central longitudinally extending axis and angular movement relative to said axis.

6. Modular target apparatus adapted to be towed behind a towing vehicle, comprising:

a tubular fore body module housing a miss distance indicator device, said module having a forward end and a trailing end, and having means for releasably connecting to a tow cable carried by the towing vehicle;

thrust bearing means at the trailing end of said module to enable relative motion; and an aft body of a larger cross-sectional area than said fore body module and releasably connectible to the latter by said thrust bearing means, said aft body having a hemi-spherical front end shaped aerodynamically to promote dynamic stability thereof when being towed, the aft body also having a trailing circular skirt which coacts with said front end to produce said dynamic stability, said aft body housing selected augmentation means for predetermined signal enhancement, and the trailing circular skirt having guide means to cause the aft body to follow a predetermined path of motion.

7. The modular target apparatus defined in claim 1 or 6, wherein said aft body augmentation means is for enhancement of a radar signal.

8. The modular target apparatus defined in claim 1 or 6 wherein said augmentation means provides enhancement of a visual signal.

9. The modular target apparatus defined in claim 1, 3 or 6, wherein at least one of the fore body and aft body is a substantially empty tube-like element.

10. The modular target apparatus of claims 1 or 6 in which the tow cable connecting means is positioned to cause the apparatus to assume a predetermined orientation when being towed.

11. The modular target apparatus of claims 1 or 6 in which the tow cable connecting means is at the center of gravity of the apparatus.

12. The apparatus of claim 11 in which the tow cable connecting means is affixed to the outer surface of the fore body.

13. The modular target apparatus of claims 1 or 6 in which the cross-sectional area of the aft body is at least three times that of the fore body.

* * * * *